United States Patent [19]

Harbolt et al.

[11] Patent Number: 5,069,352

[45] Date of Patent: Dec. 3, 1991

[54] TRANSPORTABLE CARGO CONTAINER

[75] Inventors: Bruce A. Harbolt, Northridge; Perry L. Murata, Torrance, both of Calif.

[73] Assignee: Union Oil Company of California, Los Angeles, Calif.

[21] Appl. No.: 701,585

[22] Filed: May 15, 1991

Related U.S. Application Data

[63] Continuation of Ser. No. 429,604, Oct. 31, 1989, abandoned.

[51] Int. Cl.[5] ..... B65D 87/00

[52] U.S. Cl. ..... 220/1.5; 220/410

[58] Field of Search ..... 220/1.5, 400, 408, 409, 220/410

[56] References Cited

U.S. PATENT DOCUMENTS

| | | | |
|---|---|---|---|
| 3,951,284 | 4/1976 | Fell et al. | 220/1.5 X |
| 3,980,196 | 9/1976 | Paulyson et al. | 220/1.5 |
| 4,054,226 | 10/1977 | Bjelland et al. | 220/1.5 X |
| 4,098,426 | 7/1978 | Gerhard | 220/410 X |
| 4,173,288 | 11/1979 | Schutz | 220/1.5 |
| 4,203,526 | 5/1980 | Stoll, III | 220/5 R X |
| 4,334,812 | 6/1982 | Delatush | 220/1.5 X |
| 4,359,084 | 11/1982 | Geverath et al. | 220/1.5 X |
| 4,557,400 | 12/1985 | Clarke | 220/1.5 X |
| 4,589,565 | 5/1986 | Spivey | 220/1.5 X |
| 4,613,053 | 9/1986 | Kimura et al. | 220/1.5 X |
| 4,674,127 | 6/1987 | Yamada et al. | 220/410 X |

*Primary Examiner*—Steven M. Pollard

*Attorney, Agent, or Firm*—Clark E. DeLarvin; Gregory F. Wrizbicki

[57] ABSTRACT

A substantially rigid inner container is positioned on a upper surface of a floor of an outer container. The inner container is sized to receive at least partial support from the outer container and to have a volume such that when filled to a maximum capacity the total weight of the inner container, outer container and cargo do not exceed a predetermined maximum weight.

19 Claims, 2 Drawing Sheets

TRANSPORTABLE CARGO CONTAINER

This application is a continuation of application Ser. No. 07/429,604, filed Oct. 31, 1989 now abandoned.

FIELD OF THE INVENTION

The present invention relates to a cargo container of the type suitable for transport, for instance, on a container vessel or railroad flat car and which is adapted for removable attachment to a truck. Such containers frequently are referred to as "MATSON" and "SEA LAND" containers. It particularly relates to an apparatus and method which can adapt and utilize such a container for the transport of a liquid.

BACKGROUND OF THE INVENTION

There are many types of cargo which require shipment by a combination of truck and rail, truck and ship, or a combination of all three to reach their designated marketing areas. Most existing methods of handling such products i.e., loading, handling and unloading, are generally inefficient and costly. In addition, they frequently require specialized equipment at points of transfer. In recent years containerized ships have been developed which are adapted to transport dry-bulk or packaged cargo held in specially designed containers. The containers are provided with loading and dumping hatches so they may be filled with a dry-bulk commodity, such as a particulate material, or access doors for filling with boxes, barrels and the like. The containers are then transported by rail or truck to the dockside where they are loaded onto the ship. This does away with the need for special bins or holds in the ship and for elaborate loading and unloading procedures, since the cargo remains in the container and is transported therein until it reaches its ultimate destination.

The transportation of a liquid cargo represents a more complex problem. For large bulk quantities of a liquid, such as oil, special ships or tankers have been designed which also require special loading and unloading facilities. For smaller quantities it is possible to transport a liquid in tanks or canisters. Typically, however, such tanks or canisters have a relatively small capacity and require special handling procedures. Further, the weight of the tanks or canisters relative to that of the liquid contained therein is relatively high with the associated additional shipping expense. Moreover, if the ship to be utilized is containerized and adapted to carry a dry-bulk load in containers, the same ship is not ordinarily suited for liquid loads unless special facilities are provided. Thus, there exists a need for a shipping container for liquids wherein the volume of liquid is not sufficient to warrant a special vessel and transfer facilities, but which is too great for practical shipment in barrels or canisters.

In U.S. Pat. Nos. 4,613,053 and 3,384,106, it is suggested to place a flexible bag in a rigid outer container for shipping a liquid product. A disadvantage of that approach is that the outer box must be specially designed since it must provide substantially all of the lateral support for confining the flexible bag and its liquid contents. In addition, the use of a flexible bag does not prevent wave motion of the liquid contents contained therein during transport. Any wave motion could easily result in a shift in the center of gravity of the container and its contents. The shifting center of gravity could cause an unbalanced condition that might in turn result in damage, particularly if the container was being transported on a truck.

SUMMARY OF THE INVENTION

It is an object of the present invention to provide a bulk transport container for a fluid. The term "bulk" as used herein refers to volumes in excess of 150 cubic feet.

It is another object of the invention to provide a bulk fluid container which will substantially eliminate any wave motion of the fluid (which would result in a shifting of the center of gravity of the cargo contained therein) during movement of the container.

It is still another object of the invention to provide a method by which a standard dry cargo container can be adapted to the transport of a liquid.

It is still another object of the invention to provide a fluid transport container which may be stacked and is readily transportable by land, or sea or air.

In accordance with the present invention there is provided a transportable combination cargo container for fluid and fluidizable cargo. The container includes an outer container and at least one inner container. The outer container has a floor member, an optional roof member and walls members extending there between which cooperatively form an enclosure. An access means is located in one of said members of the outer container for the introduction and removal of said at least one inner container.

In accordance with a preferred embodiment there is only one inner container. In some instances, however, more than one inner container may be utilized; for example, when more than one type of fluid is to be shipped in a single outer container it would be rare to use more than three inner containers. Moreover, as the number of inner containers increases and since the total weight of cargo must remain constant the volume of the individual containers must decrease until such time as they cease to be bulk containers as herein defined.

The inner container has a top member, bottom member and side members extending there between defining an enclosure for containing the cargo. An opening is provided in an upper portion of the enclosure for the introduction and withdrawal of cargo. A key feature of the present invention is the provision of means for providing lateral support from an inner surface of the outer container to adjacent side members of the inner container. This feature substantially eliminates or at least minimizes any bulging or flexing of the side members when the inner container is filled with cargo. This in turn permits the inner container to be formed with thinner side members than would otherwise be possible and achieves a substantial reduction in weight. Accordingly, the inner container must receive some partial support either directly or indirectly from the outer container to minimize or eliminate any flexing of the walls of the inner container.

In accordance with one embodiment of the invention, this support is obtained by sizing the inner container such that all side members are in close proximity to an inner surface of the outer container for receiving partial support therefrom. In accordance with another embodiment, two of the side members of the inner container are in close proximity to an inner surface of adjacent members of the outer container for receiving partial support therefrom and spacers are placed intermediate the other wall members of the inner container and an adjacent inner surface of the outer container. When multiple inner tanks are utilized they will be arranged to have adjacent side members in close proximity to one another, such that any horizontal deformation and corresponding loads are transferred from one inner tank to another for ultimately receiving at least partial support from an inner surface of the outer containers as hereinbefore described.

Preferably the inner container is sized to have a volume for a specific cargo which will insure that the weight of the inner container, when filled to a maximum capacity with cargo, does not exceed a predetermined maximum weight. Typically the maximum weight of the inner container and cargo will be in the range of from about 40 to 50 thousand pounds. There is also provided closure means for sealing the opening in the inner tank when cargo is not being introduced or withdrawn.

In accordance with another aspect of the invention, there is provided a method of transporting a fluid in a standard shipping container designed for shipment of solids. It is particularly applicable to transporting a liquid in a container such as a "MATSON" or "SEA LAND" container which includes means for removable attachment to a land transport vehicle. Broadly, the method comprises providing at least one inner tank having a top portion, a bottom portion and side portions extending there between which cooperatively define an enclosure for receiving fluid therein. An opening is located in an upper part of the inner tank for the introduction and withdrawal of fluid. The method further comprises means for ensuring that the side portions receive partial lateral support from a facing inner surface of the commercial shipping container, and selecting overall dimensions for said at least one inner tank to insure that at least two opposite walls of the inner tank are in close proximity to an adjacent interior surface of the standard shipping container. Preferably the tank will have a volume which, when filled to a maximum capacity with the fluid to be shipped, will have a total weight less than a predetermined maximum. The tank is placed in the shipping container and filled to the desired level with fluid. Thereafter, the tank is sealed and the shipping container closed whereupon the tank, the fluid and shipping container are placed on a vehicle for transport to another location.

In accordance with certain preferred aspects of the invention, rib members are provided which extend inwardly into the fluid containing enclosure for dampening wave motion of cargo contained therein. Alternatively, or addition thereto, an inflatable bladder may be located in the enclosure of the inner tank for further inhibiting any wave motion when the container is filled to less than maximum capacity.

In accordance with yet another embodiment of the invention, there is further provided spacer means which are placed intermediate the inner container and outer container for limiting planar movement of the inner container. In accordance with a particularly preferred aspect of the invention, the inner container is rotationally molded from a fluid impervious synthetic material. The preferred synthetic materials are the thermal setting plastics.

These and other aspects of the invention and advantages to be obtained therefrom will be more apparent from the following detailed description.

DETAILED DESCRIPTION OF THE INVENTION

Figure 1:
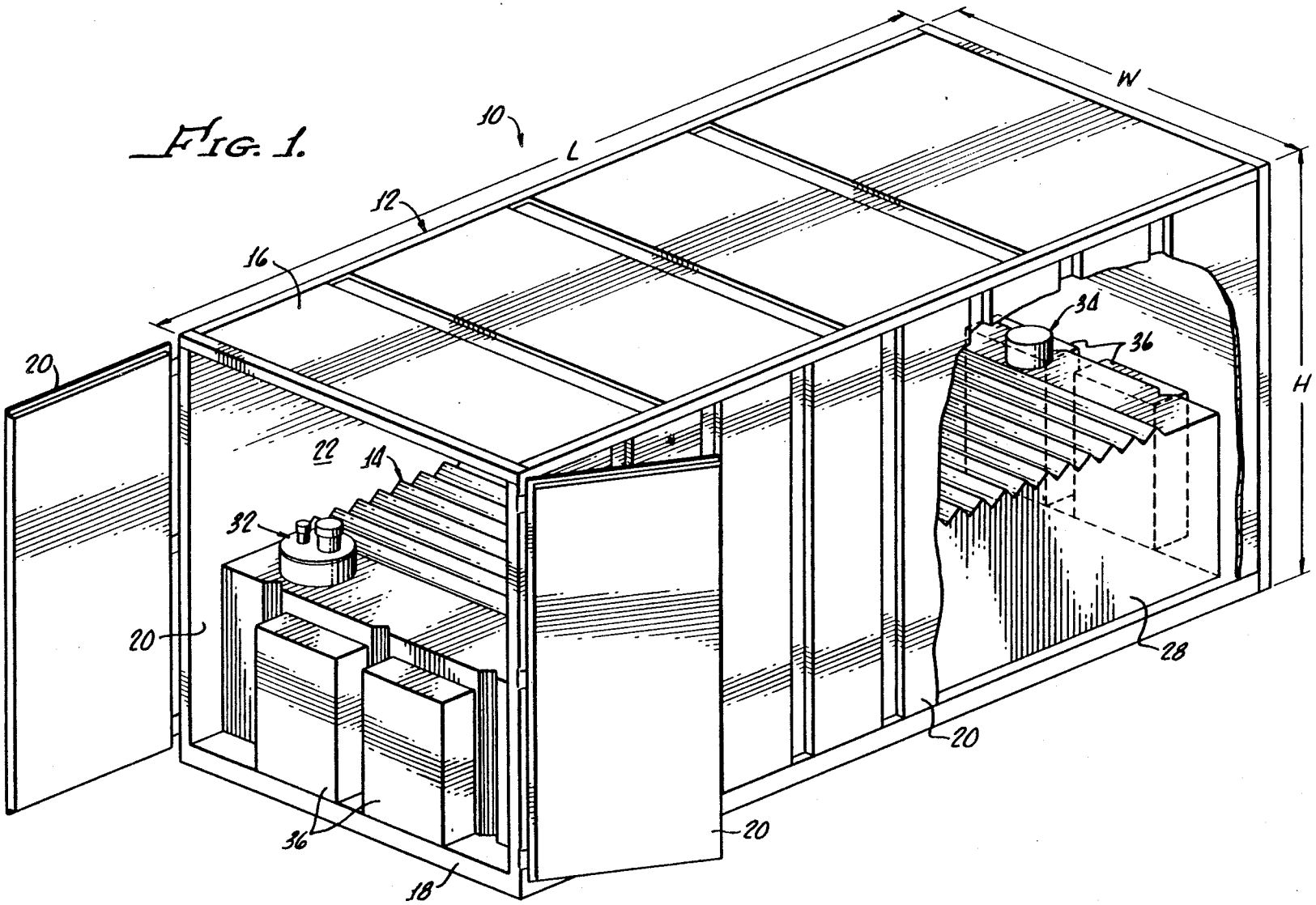
FIG. 1 is a partially sectioned general perspective view.
Figure 2:
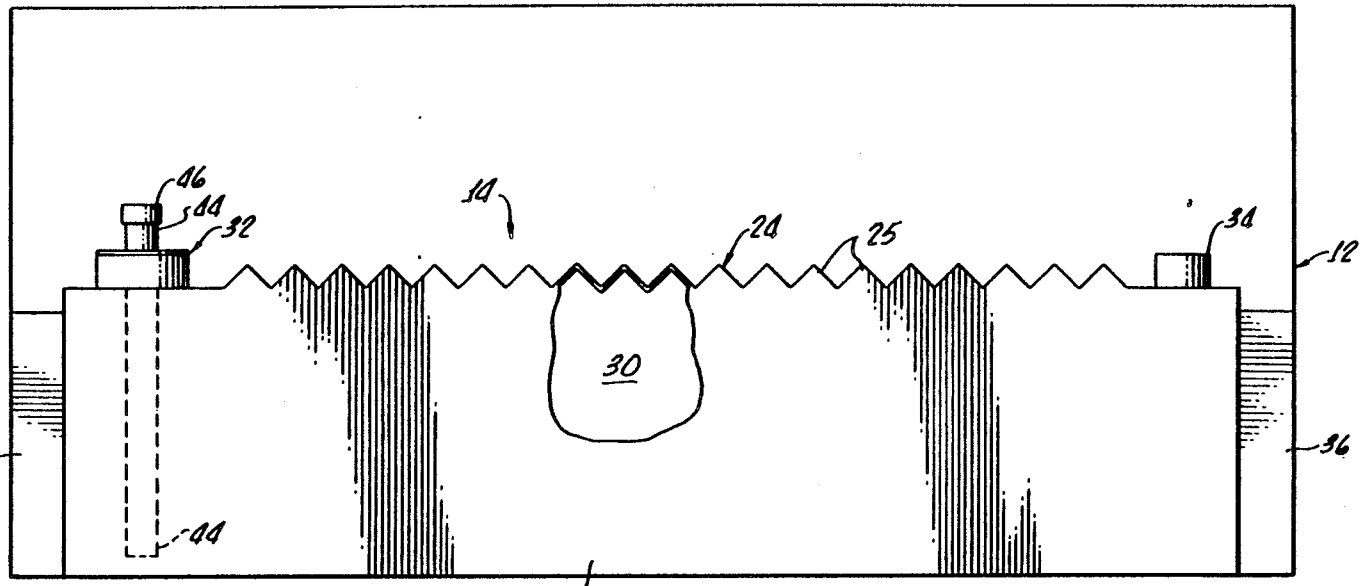
FIG. 2 is a partially sectioned side elevation view.

Referring to the drawings and FIGS. 1 and 2 in particular, therein is depicted a particularly preferred form of a transportable cargo container 10. Cargo container 10 includes an outer container 12 and an inner container 14. Outer container 12 includes an optional roof member 16, a floor member 18, and wall members 20 extending therebetween to define an enclosed space 22.

A key aspect of the present invention is inner container 14 which broadly comprises a substantially rigid structure having a top member 24, a bottom member 26 and side members 28 extending therebetween defining an enclosure for containing a fluid. In the embodiment depicted, top member 24 and side members 28 are provided with a plurality of circumferentially extending rib members 25. Rib members 25 perform two functions: (1) they add structural support to inner container 14; and (2) by projecting inwardly they function as baffles to substantially impede any wave motion of fluid container therein during transport of the container. Adjacent an upper portion of enclosure 30 there is provided a cap assembly 32.

In accordance with one embodiment of the invention, there also is provided a bladder assembly 34 which also is located adjacent an upper portion of enclosure 30. Cargo container 10 may also include one or more inserts 36, the purpose of which will be discussed in greater detail later.

Figure 3:
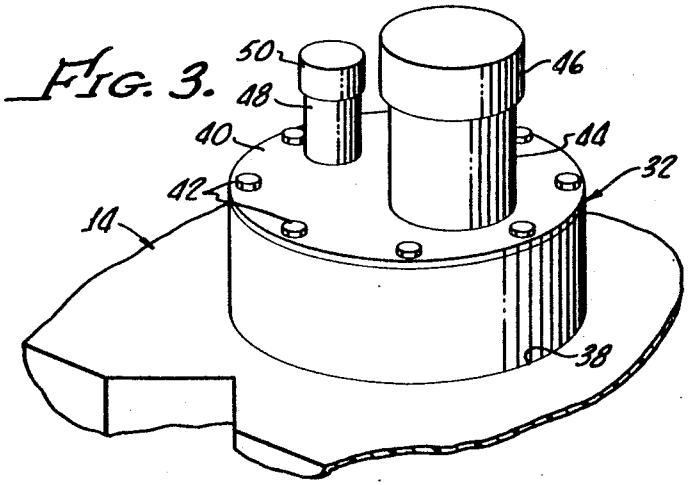
FIG. 3 is an enlarged perspective view taken at 3—3.

Referring now to FIG. 3, there is depicted an enlarged view of cap assembly 32. As shown, inner container 14 has an upwardly extending opening 38 which is sealed by a removable plate 40. Removable plate 40 typically is secured by fasteners 42 which may be screws, bolts, and the like. Advantageously, opening 38 and removable plate 40 are sized sufficiently large to allow a person to enter tank 14 in the event that mechanical cleaning of the interior is necessary. Cap assembly 32 further includes a pipe 44 which extends through plate member 40 for the introduction and withdrawal of cargo. Typically pipe 44 will extend downwardly to a point closely adjacent floor member 26 of inner container 14 (see FIG. 2). Cap assembly 32 also is provided with a vent pipe 48 which extends through plate member 40 to permit the passage of air therethrough during filling and unloading operations. In addition, both pipes 44 and 48 are provided with caps 46 and 50, respectively, for sealing inner container 14 when cargo container 10 is in transit or storage. It will be noted that by having all of the openings in inner container 14 adjacent an upper surface, the chances of any leakage during transit are substantially minimized.

Figure 4:
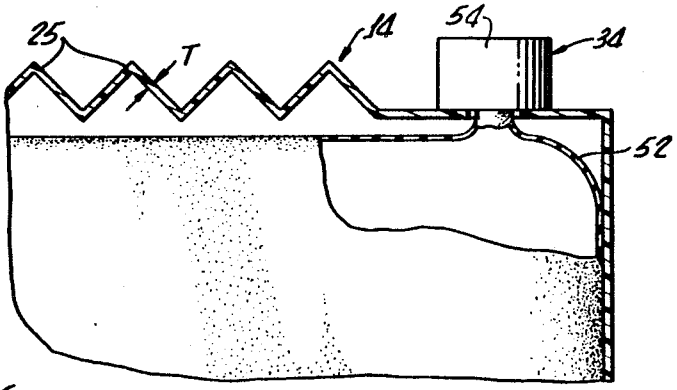
FIG. 4 is an enlarged sectional view taken at 4—4.

Referring to FIG. 4, therein is depicted an embodiment of the invention wherein inner container 14 further includes a bladder assembly 34. Bladder assembly 34 includes an inflatable bladder 52 which is in fluid communication with a means 54 for the introduction of a pressurized gas into bladder 52. Means 54 could also include a source of pressurizing gas as well as a pressure control valve to maintain some predetermined amount of pressure in bladder 52. The embodiment depicted here would be particularly useful in those instances where a portion of the cargo is to be unloaded at several different locations, since the bladder would expand to fill the resulting ullage space and provide a means of inhibiting any wave motioh during transport between those locations. Obviously, this would be particularly beneficial when the container is affixed to a truck and subjected to the starting, stopping, and turning motions of the truck.

The transportable cargo container of the present invention broadly comprises a cooperative combination of an outer container and at least one inner container. It is an essential feature of the present invention that the inner container be a substantially rigid structure. By "substantially rigid," it is meant that the container, when filled to design or maximum capacity with the fluid to be transported, be capable of holding its shape. Some lateral deformation or bulging is to be expected. Indeed, the container ideally will have a minimum wall thickness T to reduce its weight and thereby permit the maximum amount of cargo to be transferred. A minimum wall thickness will result in some bulging or flexing of the wall members.

It is intended that the inner container receive some partial support from the outer container to minimize or eliminate any flexing of the walls of the inner container. Thus, in accordance with the present invention as depicted, the inner container dimensions will be selected to ensure that at least two of the side members and the bottom member of the inner container are in close proximity to an inner surface of adjacent members of the outer container for receiving support therefrom.

It is a particular advantage of the present invention that, while the outer container may be specially constructed, a standard shipping container also may be utilized. Indeed, a preferred form of outer container is a "MATSON" or "SEA LAND" type of container. Such containers are commercially available and provided with means for removable attachment to a vehicle for land transport as well as stacking on a containerized shipping vessel. When utilizing the current invention with such a standardized outer container, certain criteria must be kept in mind. Specifically, the outer dimensions of the standard container will be dictated by laws relating to highway usage if it is to be transported by a land vehicle.

Typically, such standard containers will have a width W of approximately 8 feet, the length L may vary from as little as 18 to as much as 40 feet. The height H generally will be from about 8 to 10 feet. In addition, the maximum weight of the container and cargo cannot exceed those limits set by the governmental bodies which regulate the roads over which the container must travel. Typically, a gross weight of 80,000 pounds (tractor, trailer and contents) is a maximum acceptable weight in most states. The gross weight limit in turn restricts the maximum weight of cargo which can be placed in the container of the present invention to about 45,000 pounds.

In accordance with the invention, the inner container is sized and arranged to receive support, either directly or indirectly, from the outer container in all four horizontal directions. In accordance with one embodiment of the invention, the inner container receives direct support from the outer container on two opposite sides, and on two other sides support is provided by placing spacers intermediate the inner container and outer container, such that the inner container receives support in all horizontal directions. Thus, it is seen that the width of the inner container may be determined by the interior width of the outer container. The length of the inner container may vary somewhat if spacers are to be utilized. The height of the inner container (and resulting volume of the container) will be determined by the density of the fluid to be transported and the ultimate maximum weight which can be tolerated. Set forth in the table below are some typical dimensions for an inner tank in accordance with the present invention for fluids having different densities:

| Typical Inner Container | | | |
|---|---|---|---|
| Dimensions | | | Cargo Density |
| L W H | Vol ($Ft^3$) | | (#/$Ft^3$) |
| 18 × 7.7 × 8 | 1,125 | | 40 |
| 18 × 7.7 × 6.5 | 900 | | 50 |
| 18 × 7.7 × 5.4 | 750 | | 60 |
| 18 × 7.7 × 4.9 | 643 | | 70 |
| 18 × 7.7 × 4.1 | 563 | | 80 |
| 18 × 7.7 × 3.6 | 500 | | 90 |
| 18 × 7.7 × 3.3 | 450 | | 100 |

The inner container will be sized to ensure that the ultimate maximum weight is not exceeded when it is filled to its maximum or designed capacity. This, in turn, substantially eliminates any wave motion which might be induced into the fluid during transport which wave motion could cause imbalance during transport of the containers.

It is another advantage of the present invention that the inner container is readily fabricatable by rotational molding. Specifically, a mold is built with an inner surface having the outside configurations and dimensions of a desired inner container, a quantity of a thermal-setting polymer is placed in the mold, and the mold is slowly rotated while the polymer is heated and forms a shape conforming to that of the inner surface of the mold. There are several advantages obtained by rotational molding. Rotational molding is a far less expensive fabrication technique than machining or injection molding. It also provides a substantially unitary structure, that is to say, one free of any seams which could crack and produce leaks. In spite of the large size of the inner container, its dimensions are readily controllable and reproducible through this fabrication method. The rotational molding process also permits close control over the wall thickness of the inner container, thereby permitting the use of a minimum thickness of wall with a corresponding minimum overall weight, thus reducing that portion of gross weight which is container and maximizing that of cargo.

The following example is set forth to show a particularly preferred application of the present invention, namely, the transport of a bulk liquid cargo utilizing a commercially available outer container.

EXAMPLE

To test the utility of the present invention, an inner container mold was built to produce an inner container approximately 18 feet long by 7.7 feet wide by 3.6 feet high to be used for shipment of an aqueous fertilizer solution having a density within the range of from about 90 to 95 pounds per cubic foot. The containers had a wall thickness T of about ⅜ of an inch and the thermal setting plastic used was polyethylene. The inner tanks were placed in a standard 24-foot-long MATSON container and spacers utilized at each end to ensure that the center of gravity would be substantially in the center of the standard container. Thereafter, the inner container was filled with an aqueous solution of ammonium phosphate fertilizer.

At approximately one week intervals, two such containers of fertilizer were shipped from California to Hawaii until approximately 1000 tons of fertilizer had been transported. During this period, several modifications and variations of the invention (which have been heretofore described) were developed. Nonetheless, the foregoing test of the basic concept was deemed sufficient to prove the utility and reliability of the invention.

While the preferred embodiment of the invention has been described and alternative configurations have been suggested, it should be understood that other embodiments may be devised and modifications can be made thereto without departing from the spirit of the invention and the scope of the appended claims.

What is claimed is:

1. A transportable combination cargo container for a liquid cargo which comprises:

a single unitary inner and a single outer container;

said outer container comprising a solids shipping container having a substantially rectangular floor member, a substantially rectangular roof member, and wall members extending therebetween, said members defining an enclosure, access means located in one of said members of said outer container for the introduction and removal of said inner container, and means adjacent said floor member of said outer container for removable attachment to a vehicle;

said inner container being a substantially rigid structure having a top member, a bottom member and side members extending therebetween defining an enclosure for containing bulk volumes of said liquid, an opening adjacent an upper portion of said enclosure for the introduction and withdrawal of said liquid cargo, at least two of the side members and the bottom members of said inner container being in close proximity to an inner surface of adjacent members of said outer container for receiving support from said outer container, and a plurality of circumferentially extending rib members which extend inwardly into said enclosure for dampening wave motion of cargo contained therein; and closure means for sealing said opening in said inner tank.

2. The container of claim 1 wherein said inner container is elongated, substantially rectangular in cross section and includes a plurality of circumferentially extending rib members.

3. The container of claim 1 wherein said inner container further includes an inflatable bladder located in said enclosure.

4. The container of claim 1 further including at least one spacer means located intermediate said inner container and said outer container for limiting movement of said inner container.

5. A transportable combination cargo container for liquid cargo which comprises:

a single unitary inner and a single outer container;

said outer container comprising a land-sea shipping container having a floor member, a roof member, and wall members extending therebetween, said members defining an enclosure, access means located in one of said members of said outer container for the introduction and removal of said inner container;

said inner container being elongated, substantially rectangular in cross section, and including a plurality of circumferentially inwardly extending rib members for dampening wave motion of cargo contained therein said container having a top member, a bottom member and side members extending therebetween defining an enclosure for containing in excess of 150 cubic feet of said cargo, an opening adjacent an upper portion of said enclosure for the introduction and withdrawal of cargo, at least two of the side members and the bottom members of said inner container being in close proximity to an inner surface of adjacent members of said outer container for receiving partial support from said outer container, said inner container having a volume for ensuring that the weight of the inner container, when filled to a maximum capacity with cargo, does not exceed a maximum weight of about 45,000 pounds; and closure means for sealing said opening in said inner container.

6. The container of claim 5 wherein said outer container floor and roof members are rectangular, said wall members comprise two end walls and two side walls and said access means is in one of said end walls.

7. The container of claim 5 wherein said outer container further includes means for removable attachment to a vehicle for transport to another location.

8. The container of claim 5 wherein said inner compartment is a unitary structure.

9. The container of claim 5 wherein said inner container is a molded, fluid-impervious synthetic material.

10. The container of claim 9 wherein said outer container floor and roof members are rectangular, said wall members comprise two end walls and two side walls and said access means is in one of said end walls.

11. The compartment of claim 10 wherein said outer container further includes means for removable attachment to a vehicle for transport to another location.

12. The container of claim 5 wherein said inner container further includes an inflatable bladder located in said enclosure.

13. The container of claim 5 further including at least one spacer means located intermediate said inner container and said outer container for limiting movement of said inner container.

14. A method of transporting a fluid in a commercial land-sea shipping container designed for shipment of solids and which container includes means for removable attachment to a transport vehicle comprising:

providing an elongated unitary inner tank having a substantially rectangular cross section and having a top, a bottom and side walls extending therebetween defining an enclosure for receiving bulk volumes of fluid therein, an opening located in an upper part of said inner tank, and a plurality of circumferentially extending rib members which extend inwardly into said enclosure for dampening wave motion of cargo contained therein;

said inner tank having overall dimensions to ensure that (a) at least two opposite walls of said inner tank are in close proximity to an adjacent interior surface of said commercial shipping container, (b) said inner tank will fit within said commercial container and said inner tank will have a volume which, when filled to maximum capacity with a fluid to be shipped, said commercial shipping container, inner tank, and fluid will have a total weight less than a maximum highway transportable weight;

placing said inner tank in said commercial container;

filling said inner tank to desired level with said fluid;

closing said inner tank and said commercial container; and transporting said inner tank and commercial container by the transport vehicle to another location.

15. The method of claim 14 wherein said fluid is a liquid and said total weight is less than 45,000 pounds.

16. A method of claim 15 wherein said inner container has four walls, and the overall dimensions are selected to ensure that all four walls will be in close proximity to an inner surface of said commercial shipping container.

17. The method of claim 15 wherein said inner tank is formed by introducing a plastic material into a cavity in a mold and rotating the mold to form a layer of said plastic material in the shape of said cavity.

18. The method of claim 14 wherein said fluid is an aqueous solution of a plant fertilizer, and said total weight is less than 45,000 pounds.

19. The method of claim 14 further including placing a spacer intermediate the side walls of the inner tank and adjacent walls of said standard shipping container to limit horizontal movement of said inner tank.

* * * * *